US009193160B1

(12) United States Patent
Hamada et al.

(10) Patent No.: US 9,193,160 B1
(45) Date of Patent: Nov. 24, 2015

(54) LIQUID EJECTION HEAD

(71) Applicant: CANON KABUSHIKI KAISHA, Tokyo (JP)

(72) Inventors: Yoshihiro Hamada, Yokohama (JP); Masaki Oikawa, Inagi (JP); Hiroshi Yamada, Yokohama (JP); Yasunori Takei, Tokyo (JP); Atsushi Omura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/716,230

(22) Filed: May 19, 2015

(30) Foreign Application Priority Data

May 30, 2014 (JP) ..... 2014-112183

(51) Int. Cl.
*B41J 2/05* (2006.01)
*B41J 2/14* (2006.01)

(52) U.S. Cl.
CPC ..... *B41J 2/14145* (2013.01); *B41J 2/14112* (2013.01)

(58) Field of Classification Search
CPC .. B41J 2/14145; B41J 2/1643; B41J 2/14129; B41J 2/04; B41J 2/1628; B41J 2/1603
USPC ..... 347/20, 54, 56, 61, 63, 65
See application file for complete search history.

(56) References Cited

U.S. PATENT DOCUMENTS

| | | | | |
|---|---|---|---|---|
| 7,628,469 | B2 | 12/2009 | Inoue | |
| 8,833,901 | B2 * | 9/2014 | Hamada et al. | 347/20 |
| 2014/0292937 | A1 * | 10/2014 | Chida et al. | 347/50 |

FOREIGN PATENT DOCUMENTS

JP 2007-283501 A 11/2007

* cited by examiner

*Primary Examiner* — An Do
(74) *Attorney, Agent, or Firm* — Fitzpatrick, Cella, Harper & Scinto

(57) ABSTRACT

The invention provides a liquid ejection head equipped with an energy generating element generating energy utilized for ejecting a liquid, a liquid supply port provided at a surface on which the energy generating element is provided for supplying the liquid to the energy generating element, a liquid flow path for supplying the liquid to the energy generating element from the liquid supply port and a rib extending from the liquid supply port toward an inlet of the liquid flow path, wherein an end portion of the rib on the side of the liquid flow path is provided at a position deviated from a center line of the liquid flow path.

18 Claims, 4 Drawing Sheets

LIQUID EJECTION HEAD

BACKGROUND OF THE INVENTION

1. Field of the Invention

The present invention relates to a liquid ejection head for ejecting a liquid such as an ink to conduct recording.

2. Description of the Related Art

An ink jet recording system is generally known as a recording system in which a liquid is ejected to conduct recording. This ink jet recording system includes a method utilizing a heating resistor element (heater) as an ejection energy-generating element used for ejecting a liquid such as an ink and a method utilizing a piezoelectric element (piezo). Both elements permit controlling the ejection of the liquid by an electric signal. In a recording head using the heating resistor element, thermal energy is applied to a liquid from the heating resistor element by supplying an electric pulse which is a recording signal to the heating resistor element to bring film boiling (bubbling) to the liquid. A bubble pressure generated at this time is utilized to eject the liquid from a minute opening, thereby conducting recording on a recording medium.

FIG. 5 is a partially broken perspective view illustrating a general construction of a liquid ejection head which is a recording head using the above-described heating resistor element. The liquid ejection head illustrated in FIG. 5 is equipped with a substrate 11 and an ejection orifice forming member 12 joined to one surface of the substrate 11. A through-hole as a liquid supply port 13 is formed in the substrate 11. A plurality of heating resistor elements 14 are arranged on both sides of an opening portion of the liquid supply port 13 on the surface of the substrates 11 to which the ejection orifice forming member 12 is joined.

In addition, FIG. 6A illustrates a plan view of the liquid ejection head when viewed from the side of the ejection orifice forming member 12. FIG. 6B illustrates a sectional view taken along line 6B-6B in FIG. 6A. As illustrated in FIGS. 6A and 6B, the ejection orifice forming member 12 is equipped with pressure chambers 15 arranged accordingly to the respective heating resistor elements 14, a plurality of liquid flow paths 17 for supplying a liquid such as an ink to the respective pressure chambers 15, a common liquid chamber 18 collectively communicating the plural liquid flow paths 17 with said one liquid supply port 13 and ejection orifices 19 communicating with the respective pressure chambers 15. The liquid flow paths 17, the common liquid chamber 18 and the ejection orifices 19 are formed of hollow portions such as grooves or holes formed in the surface of the ejection orifice forming member 12 on the side of the substrate 11.

Since the ejection orifice forming member 12 is equipped with the hollow portions such as the liquid flow paths 17 and the common liquid chamber 18, the member is a member brittle against external force. Therefore, a beam-like structure (hereinafter referred to as a beam 20) having a plurality of reinforcing ribs 20*a* is provided at a position of the common liquid chamber 18 facing the liquid supply port 13 in the ejection orifice forming member 12, thereby improving the rigidity of the ejection orifice forming member 12. The beam 20 and the reinforcing ribs 20*a* are formed in the form of a projecting line and brought into close contact with the substrate 11.

In addition, the reinforcing ribs 20*a* extend with a fixed thickness in the vicinity of an inlet of an optional liquid flow path 17 from the beam 20. At this time, the reinforcing ribs 20*a* are each formed on a line extending from a center line Y passing through a center of a flow path width d of the liquid flow path 17.

The fact that the beam 20 and the reinforcing ribs 20*a* are formed for improving the rigidity of the ejection orifice forming member 12 as described above is disclosed in Japanese Patent Application Laid-Open No. 2007-283501.

In the construction illustrated in FIGS. 6A and 6B, however, it has been found that when a bubble is generated in the vicinity of a side wall (hereinafter referred to as an end wall) on the side opposite to the liquid flow path 17 among side walls of the pressure chamber 15, the bubble is hard to be discharged from the pressure chamber 15.

A cause for this is as follows. Since a center line of the reinforcing rib 20*a* conforms to a center line Y of the liquid flow path 17 as understood from FIG. 6A, two gaps located between an end portion in a longitudinal direction of the reinforcing rib 20*a* and two side wall portions 17*a* of the liquid flow path 17 have the same size. In this case, liquid flows flowing toward the pressure chamber 15 from the two gaps through the liquid flow path 17 are flows having uniform velocity over the flow path width d of the liquid flow path 17. A bubble located in the vicinity of the end wall of the pressure chamber 15 is thereby pressed against the end wall and cannot be moved, so that there is a possibility that the bubble may stay in the pressure chamber for a long period of time.

In addition, the end portion in the longitudinal direction of the reinforcing rib 20*a* is arranged in the vicinity of the inlet of the liquid flow path 17, so that a flow resistance in the vicinity of the inlet of the liquid flow path 17 becomes high, and the force of the liquid flowing into the liquid flow path 17 becomes weak.

For the reason described above, the bubble generated in the vicinity of the end wall of the pressure chamber 15 is hard to be discharged from the pressure chamber 15. In addition, when the bubble stays in the pressure chamber 15, the growth of a bubble upon bubbling of the liquid is inhibited, and so stable bubbling cannot be conducted, and there is a possibility that ejection failure may be caused.

SUMMARY OF THE INVENTION

The present invention provides a liquid ejection head comprising a substrate, an ejection orifice forming member joined to the substrate, in which ejection orifices ejecting a liquid have been formed, a plurality of energy generating elements arranged in a row on the surface of the substrate, to which the ejection orifice forming member has been joined, and generating energy for ejecting the liquid, and a liquid supply port formed in the substrate and having an opening portion at said surface, wherein the ejection orifice forming member is formed face to face with the plural energy generating elements, and which further comprises a plurality of pressure chambers respectively communicating with the ejection orifices, a plurality of liquid flow paths supplying the liquid to the plural pressure chambers, a common liquid chamber communicating the plural flow paths with the liquid supply port and a reinforcing rib formed in the common liquid chamber and extending from a position facing the liquid supply port toward an inlet of each of the liquid flow paths, wherein an end portion in a longitudinal direction of the reinforcing rib is arranged in the vicinity of the inlet of the liquid flow path and formed in such a manner that a center line of the reinforcing rib deviates in an arranging direction of the ejection orifices from a center line passing through the center of the liquid flow path in the arranging direction.

The present invention also provides a liquid ejection head comprising an energy generating element generating energy utilized for ejecting a liquid, a liquid supply port provided at a surface on which the energy generating element is provided for supplying the liquid to the energy generating element, a liquid flow path for supplying the liquid to the energy generating element from the liquid supply port and a rib extending from the liquid supply port toward an inlet of the liquid flow path, wherein an end portion of the rib on the side of the liquid flow path is provided at a position deviated from a center line of the liquid flow path.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1A:
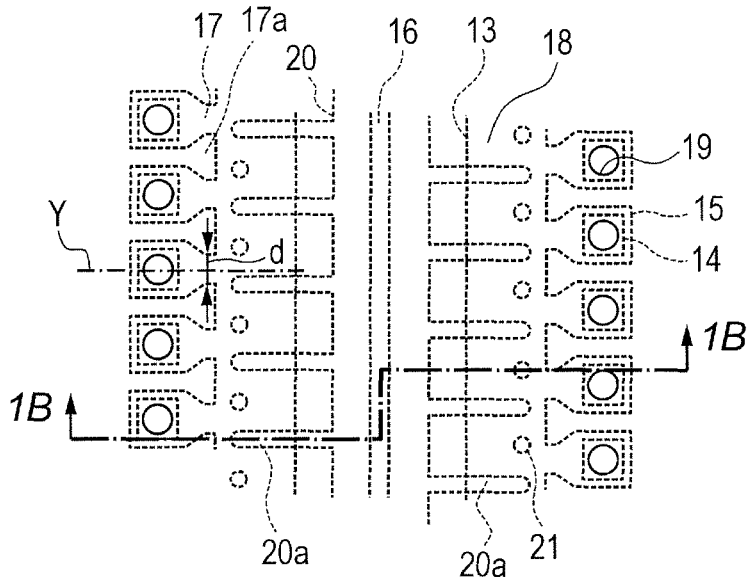
FIGS. 1A, 1B and 1C illustrate a liquid ejection head according to a first embodiment.
Figure 1B:
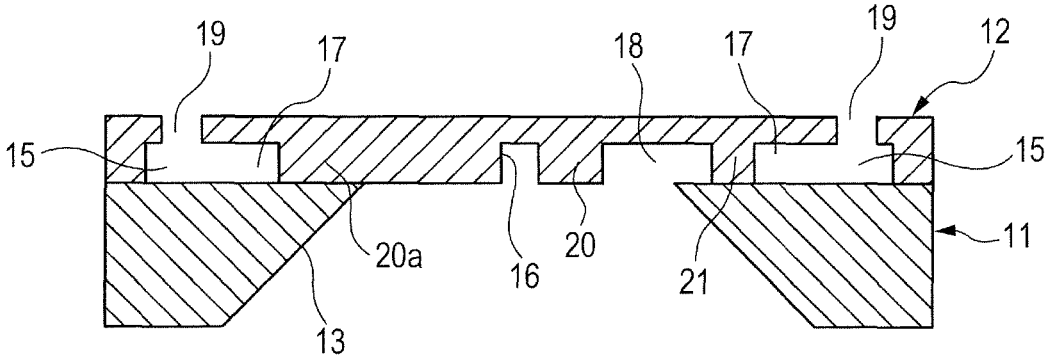
Figure 1C:
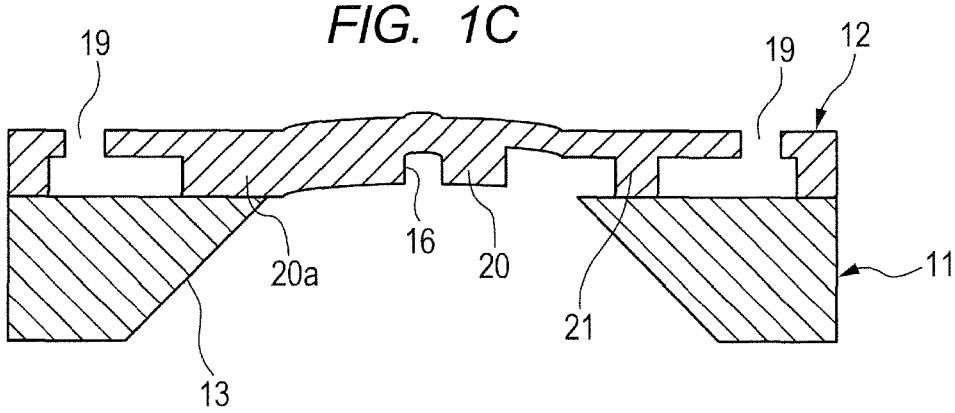
Figure 6A:
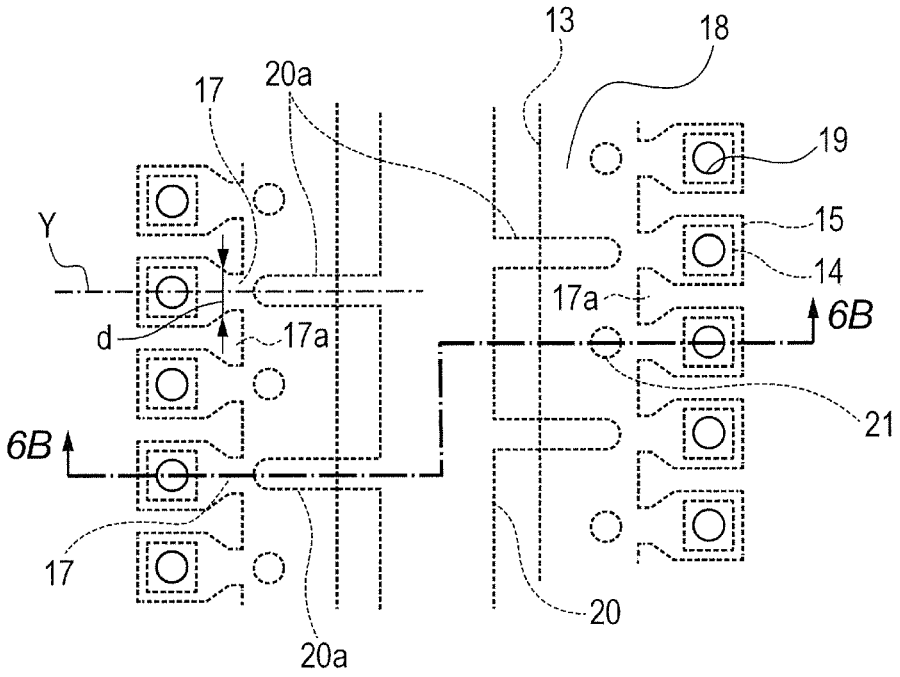
FIGS. 6A and 6B illustrate a construction of a conventional liquid ejection head.
Figure 6B:
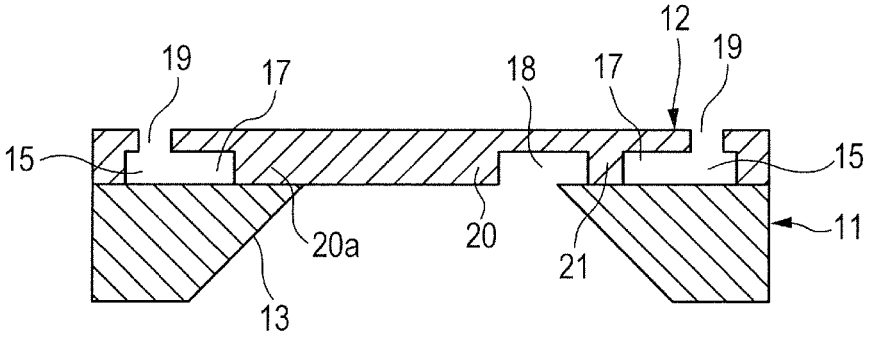

FIG. 1A illustrates a plan view of a liquid ejection head according to the first embodiment when viewed from a surface (hereinafter referred to as an ejection orifice plane) in which an ejection orifice has been formed, and FIGS. 1B and 1C illustrate sectional views taken along line 1B-1B in FIG. 1A. The first embodiment will hereinafter be described. The same components as the components of the liquid ejection head illustrated in FIGS. 6A and 6B are described with the same signs. As illustrated in FIGS. 1A to 1C, a liquid supply port 13 pierces from a first surface of the substrate 11 to a second surface opposite to said surface. An ejection orifice forming member 12 is joined to the first surface. An opening portion of the liquid supply port 13 in the first surface has a rectangular shape. In addition, heating resistor elements 14 as ejection energy generating elements are arranged on the first surface along respective long sides of the rectangular opening portion of the liquid supply port 13. The 2 element arrays composed of the plurality of the heating resistor elements 14 arranged in rows along the 2 long sides are arrayed in the state of a zigzag. Each element array has heating resistor elements 14 arrayed at a pitch of 300 dpi, and 2 element arrays (the total number of the heating resistor elements 14 in both arrays: 528) are arrayed in the zigzag state, whereby a dot image of a pitch of 600 dpi can be printed.

The ejection orifice forming member 12 joined to the first surface of the substrate 11 is composed of a photosensitive resin member. Pressure chambers 15 arranged accordingly to the respective heating resistor elements 14, a plurality of liquid flow paths 17 for supplying a liquid such as an ink to the plural pressure chambers 15, a common liquid chamber 18 collectively communicating the plural liquid flow paths 17 with one liquid supply port 13 and ejection orifices 19 communicating with the respective pressure chambers 15 are formed in the ejection orifice forming member 12.

The pressure chambers 15, the liquid flow paths 17, the common liquid chamber 18 and the ejection orifices 19 are formed by working grooves or holes in a surface of a photosensitive resin layer by a photolithographic process. Incidentally, a material other than the resin may also be used to form the ejection orifice forming member 12 having elements such as the pressure chambers 15. In addition, the pressure chamber is also called a bubbling chamber in the ejection system utilizing the heating resistor element.

The respective ejection orifices 19 are provided at positions corresponding to the respective heating resistor elements 14. Therefore, an ejection orifice array composed of the plural ejection orifices 19 is formed in the ejection orifice forming member 12, and the arranging direction of the ejection orifices 19 is along a longitudinal direction of the rectangular opening portion of the liquid supply port 13. The length of the ejection orifice array is, for example, about 0.43 inch.

A beam (beam-like projection) 20 having a plurality of reinforcing ribs 20*a* and columns (columnar projections) 21 which are plural columnar members is provided within the common liquid chamber 18 which is a hollow portion of the ejection orifice forming member 12, whereby the rigidity of the ejection orifice forming member 12 is improved. The beam 20, the reinforcing ribs 20*a* and the columns 21 are integrally formed in a state projected toward the first surface of the substrate 11 from the ejection orifice forming member 12 and joined to the substrate 11.

The beam 20 is arranged over the longitudinal direction of the opening portion of the liquid supply port 13 rectangularly opened to the first surface. Both ends in the longitudinal direction of the beam 20 are brought into close contact with the substrate 11 across the liquid supply port 13 (not illustrated). A groove (hereinafter referred to as a slit 16) is formed along the longitudinal direction of the beam 20 at the center of the beam 20.

The thicknesses (heights from the first surface of the substrate 11) of the beam 20 and the ejection orifice forming member 12 are the same as each other and 26 μm. The depth of the slit 16 is equal to the thickness of a portion of the ejection orifice forming member 12, at which the pressure chambers 15 and the liquid flow paths 17 have been formed and 10 μm. The width of the beam 20 is 62.5 μm including the slit 16. The width of the slit 16 is 14 μm.

The column 21 is arranged in the vicinity of the inlet of each liquid flow path 17 communicating with the pressure chamber 15 for the purpose of preventing dust from reaching the ejection orifice 19. In addition, the reinforcing ribs 20*a* are formed within the common liquid chamber and extend in a direction intersecting an extending direction of the beam 20 located at a position facing the liquid supply port 13 from both side wall portions of the beam 20. A tip portion in a longitudinal direction of each reinforcing rib 20*a* is arranged in the vicinity of the inlet of each liquid flow path 17. The thickness (the width in a direction orthogonally intersecting an extending direction of the reinforcing rib 20*a* and parallel with the first surface of the substrate 11) of the reinforcing rib 20*a* is equal to the diameter of the column 21. The thicknesses of the reinforcing rib 20*a* and the column 21 are equal to the thickness of the ejection orifice forming member 12 and 26 μm.

In case of the first embodiment, the reinforcing rib 20*a* and the column 21 are arranged at every liquid flow path 17, and the column 21 and the reinforcing rib 20*a* are alternately arranged along the arranging direction of the ejection orifices 19. In addition, the reinforcing rib 20*a* and the column 21 arranged in the vicinity of the inlet of each liquid flow path 17 are located at positions deviated in opposite directions to each other from the line extending from the center line Y. Further, the reinforcing rib 20*a* and the column 21 are formed on a line deviated in the arranging direction of the ejection orifices 19 from the center line Y passing through the center of the flow path width d of the liquid flow path 17.

Incidentally, since the ejection orifice forming member 12 is comprised of the resin, it swells with a solvent contained in an ink when the ink is used as the liquid ejected from the ejection orifice. When the ejection orifice forming member 12 swells as illustrated in FIG. 1C, shear stress against the reinforcing rib 20*a* and the column 21 and bending stress against the slit 16 are transmitted. The reinforcing rib 20*a* is provided, whereby a close contact area between the ejection orifice forming member 12 and the substrate 11 is ensured whereby rigidity in an extending direction of the reinforcing rib 20*a* is improved. In addition, the portion of the slit 16 becomes flexible and is easy to be bent because the thickness of the ejection orifice forming member 12 is reduced. The portion of the slit 16 is deformed without separating the reinforcing rib 20*a* and the column 21 from the substrate 11 by the effect brought by these. Since the portion of the slit 16 deformed does not relate to the ejection performance of each ejection orifice 19, no ejection failure is caused even when the ejection orifice forming member 12 swells. Incidentally, the column may not be present so far as the rigidity of the ejection orifice forming member 12 is improved by the reinforcing rib 20*a* alone as described above.

An ejection operation in case where the liquid ejection head according to this embodiment is applied to an ink jet recording head for ejecting an ink on a recording medium such as paper or a resin sheet to record an ink image will now be described. The ink is supplied to the pressure chamber 15 passing through the liquid flow path 17 through the liquid supply port 13 and the common liquid chamber 18 from an ink supply section (not illustrated), and the ejection orifice 19 is filled with the ink. When a printing signal is transmitted to an ejection control section of the ink jet recording head from a printer (not illustrated), an optional heating resistor element 14 is selected according to an image intended to be printed, and a current is applied to the heating resistor element 14. The ink is heated by the heating resistor element 14 and film-boiled (bubbled) on the heating resistor element 14. An ink droplet is ejected from the ejection orifice by the bubbling to form an image on a recording medium (not illustrated).

Incidentally, the liquid ejection head according to this embodiment is not limited to the use for recording like the ink jet recording head and may also be applied to a head for ejecting a liquid such as an ink containing an electroconductive nanoparticle such as gold, silver or copper, a resist, a UV-curable resin, a protein or a special liquid according to the ink jet system.

The action and effect brought by the liquid ejection head according to this embodiment will now be described. FIGS. 2A to 2D are views for schematically illustrating the operation of a bubble with the flow of a liquid supplied to the pressure chamber 15 through the liquid flow path 17 from the common liquid chamber 18 in case where the bubble is generated in the vicinity of the end wall (the side wall on the side opposite to the liquid flow path 17 among side walls of the pressure chamber 15) of the pressure chamber 15. Incidentally, arrows in FIGS. 2A to 2D indicate the flow and direction of the liquid and a proceeding position of the flow.

Figures 2A, 2B, 2C, 2D:
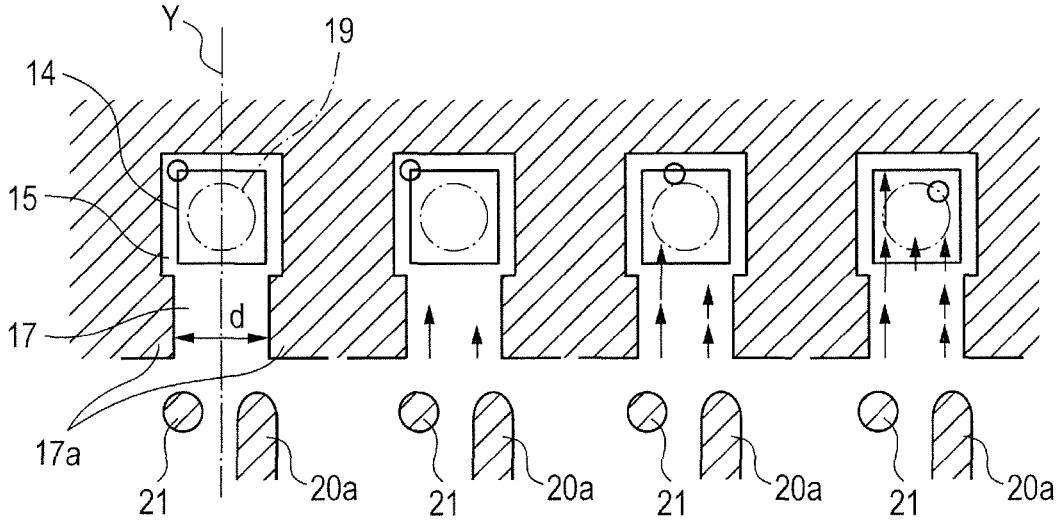
FIGS. 2A, 2B, 2C and 2D are views for schematically illustrating a flowing operation of a liquid into a pressure chamber in the first embodiment.

As illustrated in FIG. 2A, one end portion of the reinforcing rib 20*a* and the column 21 are arranged in the vicinity of the inlet of the liquid flow path 17. These inhibit the flow of the liquid supplied to the liquid flow path 17 from the common liquid chamber 18. The reinforcing rib 20*a* and the column 21 are located at positions deviated in opposite directions to each other from the line extending from the center line Y of the liquid flow path 17. In particular, the reinforcing rib 20*a* extends from the vicinity of the inlet of the liquid flow path 17 to the beam 20 and is longer than the diameter of the column 21. Accordingly, a flow resistance in the vicinity of the reinforcing rib 20*a* is high compared with a flow resistance in the vicinity of the column 21.

Therefore, with respect to a flow speed of the liquid supplied to the liquid flow path 17, as illustrated in FIG. 2B, a liquid supply speed from the side on which the reinforcing rib 20*a* is arranged becomes slower than a liquid supply speed from the side on which the column 21 is arranged. The liquid in which a difference between the liquid supply speeds is created as described above flows toward the end wall of the pressure chamber 15 from the liquid flow path 17 as illustrated in FIG. 2C, so that the bubble within the pressure chamber 15 is moved.

That is, the flow of the liquid within the pressure chamber 15 becomes, for example, a swirled flow, and so the movement of the bubble within the pressure chamber 15 can be promoted. The bubble is thereby moved on the heating resistor element 14 without attaching to the end wall of the pressure chamber 15 as illustrated in FIG. 2D. Since the bubble moved on the heating resistor element 14 is discharged from the ejection orifice 19 together with the liquid upon the next ejection, stable bubbling can be conducted to inhibit ejection failure.

When the liquid ejection head according to the present invention is utilized as an ink jet recording head using the heating resistor element in particular, a bubbling operation for ejecting an ink is stabilized, so that recording quality on a recording medium is not lowered.

For comparing with this embodiment, FIGS. 3A to 3D schematically illustrate the operation of a bubble in case where the bubble is generated in the vicinity of the end wall of the pressure chamber 15 in the conventional liquid ejection head illustrated in FIGS. 6A and 6B. Incidentally, arrows in FIGS. 3A to 3D also indicate the flow and direction of the liquid and a proceeding position of the flow.

Figures 3A, 3B, 3C, 3D:
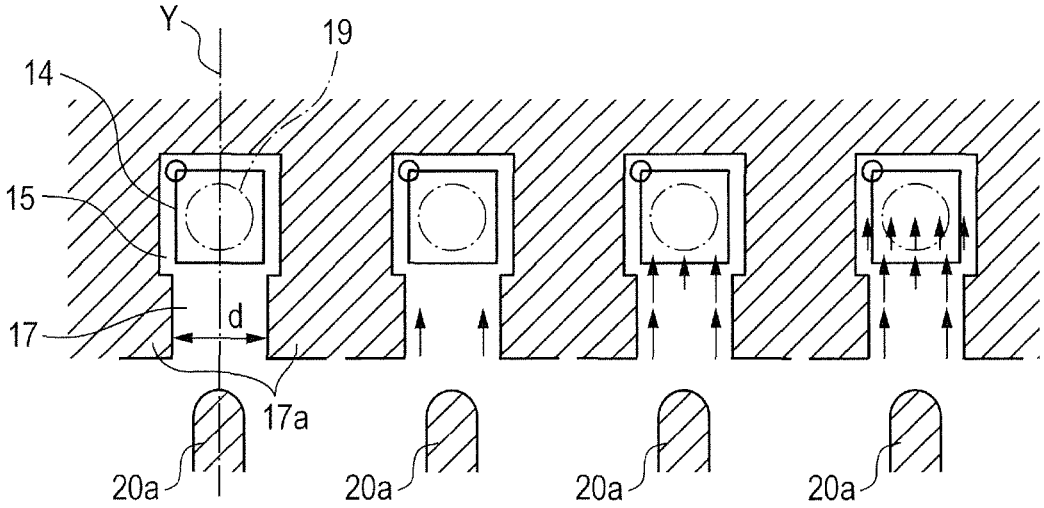
FIGS. 3A, 3B, 3C and 3D are views for comparing with the liquid flowing operation in FIGS. 2A to 2D.

In the reinforcing rib 20*a* illustrated in FIG. 3A, the center of the rib conforms to the center line Y of the liquid flow path 17, and the rib is formed with an equal width on both sides from a line extending from the center line Y of the liquid flow path 17. Therefore, two gaps located between an end portion in a longitudinal direction of the reinforcing rib 20*a* and two side wall portions 17*a* of the liquid flow path 17 have the same size. In this case, there is no difference in flow speed between liquid flows supplied to the liquid flow path 17 from the respective hollow portions located on both sides from the center of the reinforcing rib 20*a* as illustrated in FIG. 3B. Accordingly, a liquid flow toward the end wall of the pressure chamber 15 from the liquid flow path 17 becomes a flow even in flow speed over the flow path width d of the liquid flow path 17 as illustrated in FIG. 3C. A bubble located in the vicinity of the end wall of the pressure chamber 15 is thereby pressed against the end wall of the pressure chamber as illustrated in FIG. 3D and is hard to be moved. In addition to such a phenomenon, the reinforcing rib 20*a* hinders the flow of the liquid supplied to the liquid flow path 17, and so the speed of the liquid supplied into the pressure chamber 15 becomes insufficient. Accordingly, the structure of the reinforcing rib 20*a* in the conventional liquid ejection head (FIGS. 6A and 6B) makes the bubble located in the vicinity of the end wall of the pressure chamber 15 hard to be discharged.

Second Embodiment

Figure 4:
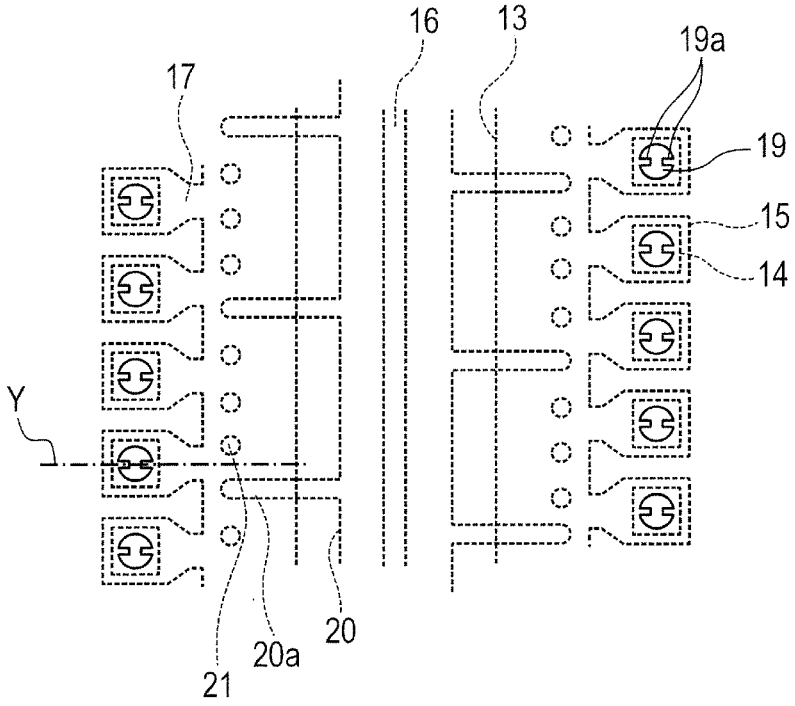
FIG. 4 illustrates a liquid ejection head according to a second embodiment.
Figure 5:
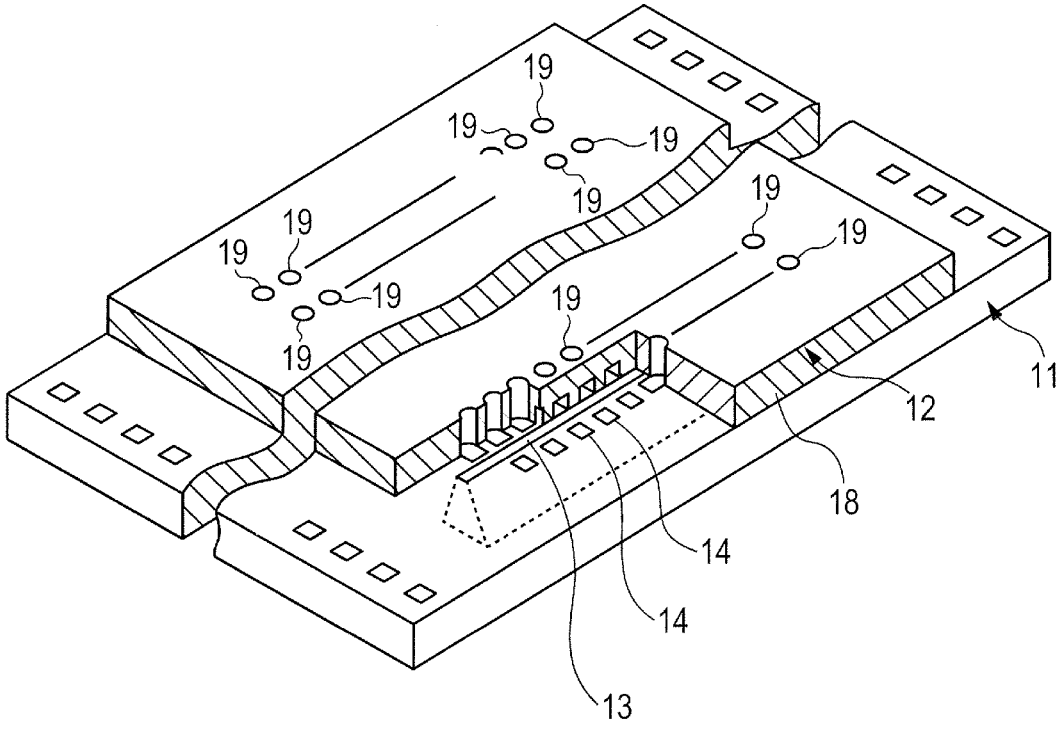
FIG. 5 illustrates a general liquid ejection head in an ink jet recording system.

The second embodiment will now be described. The same components as the components of the liquid ejection head according to the first embodiment are described with the same signs. FIG. 4 illustrates a plan view of a liquid ejection head according to the second embodiment when viewed from the side of an ejection orifice plane.

In the first embodiment, the reinforcing rib 20*a* and the column 21 have been arranged in each of the plural liquid flow paths 17. However, the liquid ejection head according to the second embodiment may also have a construction that the reinforcing rib 20*a* and the column 21 are arranged at every other liquid flow path 17 as illustrated in FIG. 4, and 2 columns are respectively arranged at other liquid flow paths 17.

According to such the construction, the flow of the liquid supplied to the liquid flow path 17 is not hindered in the liquid flow path 17 at which the 2 columns are arranged because no reinforcing rib 20*a* is arranged, and so the liquid can be supplied to the pressure chamber at a speed sufficient to move a bubble within the pressure chamber 15. In addition, the number of the reinforcing ribs 20*a* is lessened compared with the first embodiment, whereby a flow resistance from the liquid supply port 13 to each pressure chamber 15 of the ejection orifice forming member 12 can be lowered, and so a refill speed of the liquid to the whole ejection orifice array can be raised.

Quite naturally, this embodiment is not limited to the arrangement of the reinforcing rib 20*a* at every other liquid flow path 17 among the plural liquid flow paths 17 as described above, and the reinforcing rib 20*a* may also be arranged at every several liquid flow paths 17 (for example, at every 3 liquid flow paths) among the plural liquid flow paths 17.

In addition, with respect to the liquid flow path 17 at which the reinforcing rib 20*a* has been arranged, a speed of the liquid supplied to the pressure chamber 15 varies over the flow path width d of the liquid flow path 17. The shape of a trailing portion of the liquid at the time the liquid has been ejected from the ejection orifice 19 is deflected in the arranging direction of the ejection orifices 19. As a result, an ejecting direction of the liquid varies between adjoining ejection orifices 19, which may lower the impact accuracy of the liquid at a target position on an ejection object. The term "trailing" means a phenomenon that the liquid leaves a trail backward when the liquid is ejected from the ejection orifice 19.

In order to suppress the deflection of such a shape of the trailing portion of the liquid upon the liquid ejection as described above, 2 projections 19*a* facing each other are formed on an inside surface of each ejection orifice 19 as illustrated in FIG. 4, and each projection 19*a* projects in a direction orthogonally intersecting the arranging direction of the ejection orifices 19. The ejecting directions of the liquid from the adjoining ejection orifices 19 are thereby made equal, so that the impact accuracy of the liquid at the target position on the ejection object is not lowered. The fact that the projections 19*a* are formed in the ejection orifice 19 as described above may also be applied to the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112183, filed May 30, 2014, which is hereby incorporated by reference herein in its entirety.

What is claimed is:

1. A liquid ejection head comprising:

a substrate;

an ejection orifice forming member joined to the substrate, ejection orifices ejecting a liquid having been formed in the ejection orifice forming member;

a plurality of energy generating elements arranged in a row on the surface of the substrate, to which the ejection orifice forming member has been joined, and generating energy for ejecting the liquid; and a liquid supply port formed in the substrate and having an opening portion at the surface, wherein the ejection orifice forming member is formed face to face with the plural energy generating elements, wherein the ejection orifice forming member further comprises a plurality of pressure chambers respectively communicating with the ejection orifices, a plurality of liquid flow paths supplying the liquid to the plural pressure chambers, a common liquid chamber communicating the plural flow paths with the liquid supply port and a reinforcing rib formed in the common liquid chamber and extending from a position facing the liquid supply port toward an inlet of at least one of the liquid flow paths, wherein an end portion in a longitudinal direction of the reinforcing rib is arranged in the vicinity of the inlet of the at least one liquid flow path and formed in such a manner that a center line of the reinforcing rib deviates in an arranging direction of the ejection orifices from a center line passing through the center of the at least one liquid flow path in the arranging direction.

2. The liquid ejection head according to claim 1, wherein the reinforcing rib is formed in plural correspondingly to each of the plural liquid flow paths.

3. The liquid ejection head according to claim 1, wherein the reinforcing rib is formed in plural accordingly to every several liquid flow paths among the plural liquid flow paths.

4. The liquid ejection head according to claim 1, wherein the ejection orifice forming member is further equipped with a column arranged in the vicinity of an inlet of the at least one liquid flow path and extending from the ejection orifice forming member to the substrate.

5. The liquid ejection head according to claim 4, wherein the column and the reinforcing rib are located at positions deviated in opposite directions to each other from the center line in the vicinity of the inlet of the at least one liquid flow path.

6. The liquid ejection head according to claim 1, wherein a projection is provided on an inside surface of at least one of the ejection orifices.

7. The liquid ejection head according to claim 1, wherein the ejection orifice forming member is comprised of a resin.

8. The liquid ejection head according to claim 1, wherein the energy generating elements comprise heating resistor elements.

9. A liquid ejection head comprising an energy generating element generating energy utilized for ejecting a liquid;

a liquid supply port provided at a surface on which the energy generating element is provided for supplying the liquid to the energy generating element;

a liquid flow path for supplying the liquid to the energy generating element from the liquid supply port; and a rib extending from the liquid supply port toward an inlet of the liquid flow path, wherein an end portion of the rib on the side of the liquid flow path is provided at a position deviated from a center line of the liquid flow path.

10. The liquid ejection head according to claim 9, wherein in the vicinity of the inlet of the liquid flow path, a columnar member is provided at a position deviated from a center line of the liquid flow path.

11. The liquid ejection head according to claim 10, wherein in the vicinity of the inlet of the liquid flow path, the end portion of the rib is arranged on one side from a center line of the liquid flow path, and the columnar member is arranged on the other side.

12. The liquid ejection head according to claim 10, wherein the rib and the columnar member are alternately provided.

13. The liquid ejection head according to claim 9, further comprising an ejection orifice forming member in which an ejection orifice ejecting the liquid is formed, wherein the rib is formed integrally with the ejection orifice forming member.

14. The liquid ejection head according to claim 13, wherein the ejection orifice forming member is composed of a resin.

15. The liquid ejection head according to claim 13, wherein a beam extending along a longitudinal direction of the liquid supply port is provided at a position facing the liquid supply port in the ejection orifice forming member.

16. The liquid ejection head according to claim 15, wherein a slit is provided in the beam along the longitudinal direction.

17. The liquid ejection head according to claim 15, wherein the rib is formed integrally with the beam.

18. The liquid ejection head according to claim 10, further comprising an ejection orifice forming member in which an ejection orifice ejecting the liquid is formed, wherein the rib and the columnar member are formed integrally with the ejection orifice forming member.

* * * * *